US008272335B2

(12) United States Patent
Derocher et al.

(10) Patent No.: US 8,272,335 B2
(45) Date of Patent: Sep. 25, 2012

(54) TABLETOP CABLE MANAGEMENT

(75) Inventors: Mike Derocher, Albany, OR (US); Stephen DeSaulles, London (GB); Amos Marchant, London (GB); Paul Harris, London (GB)

(73) Assignee: Hewlett-Packard Development Company, L.P., Houston, TX (US)

( * ) Notice: Subject to any disclaimer, the term of this patent is extended or adjusted under 35 U.S.C. 154(b) by 707 days.

(21) Appl. No.: 12/236,335

(22) Filed: Sep. 23, 2008

(65) Prior Publication Data

US 2009/0178844 A1 Jul. 16, 2009

Related U.S. Application Data

(60) Provisional application No. 61/021,126, filed on Jan. 15, 2008.

(51) Int. Cl.
*A47B 37/00* (2006.01)

(52) U.S. Cl. ..... 108/50.02

(58) Field of Classification Search ..... 248/51; 108/27, 23, 64, 50.01, 50.02; 312/223.1, 312/223.3, 223.6, 140.3, 140.4
See application file for complete search history.

(56) References Cited

U.S. PATENT DOCUMENTS

| | | | | | |
|---|---|---|---|---|---|
| 2,172,297 | A * | 9/1939 | Snyder | 248/51 |
| 2,737,430 | A * | 3/1956 | Ess | 108/64 |
| 2,787,382 | A * | 4/1957 | Williams | 108/157.13 |
| 3,481,570 | A * | 12/1969 | Shettel | 248/51 |
| 4,612,717 | A * | 9/1986 | Alvarez | 38/104 |
| 4,988,062 | A * | 1/1991 | London | 248/68.1 |
| 5,065,964 | A * | 11/1991 | Polak | 248/51 |
| 5,341,749 | A * | 8/1994 | Noakes | 108/64 |
| 5,556,061 | A * | 9/1996 | Dickie | 248/51 |
| 5,636,822 | A * | 6/1997 | Hendershot et al. | 248/346.01 |
| 5,727,343 | A * | 3/1998 | Wehner et al. | 38/141 |
| 5,901,930 | A * | 5/1999 | Harrel | 248/51 |
| 5,974,985 | A * | 11/1999 | Flototto et al. | 108/157.18 |
| 6,732,660 | B2 * | 5/2004 | Dame et al. | 108/50.01 |
| 6,874,736 | B1 * | 4/2005 | Jones et al. | 248/118 |
| 2004/0232291 | A1 * | 11/2004 | Carnevali | 248/206.5 |

* cited by examiner

*Primary Examiner* — Jose V Chen
*Assistant Examiner* — Matthew Ing

(57) ABSTRACT

A cable manager for a tabletop includes raceway and a holder. The tabletop includes a support surface and an edge surface. The raceway is for a cable having an end with a plug. The raceway is configured to be positioned lengthwise along at least a portion of a length of the edge surface. The raceway provides a slot along and through which the cable can, with respect to the support surface, be moved laterally and extended and retracted. The holder is configured to be positioned on the support surface and to retain the plug in a stationary position at a first location adjacent to the support surface. The plug is removable from the holder to be repositioned to a desired one of a plurality of second locations adjacent to the support surface.

20 Claims, 4 Drawing Sheets

TABLETOP CABLE MANAGEMENT

CROSS-REFERENCE TO RELATED APPLICATIONS

This Application claims the benefit of U.S. Provisional patent application Ser. No. 61/021,126, filed Jan. 15, 2008, which is hereby incorporated by reference in it's entirety.

BACKGROUND

Network video conferencing allows attendees to participate in a meeting even when various attendees are located in rooms in different cities around the globe. Each video conferencing room typically includes audio visual equipment to capture events occurring in that room and to display events occurring in the other video conferencing rooms involved in a meeting. A table in a video-conferencing room can provide a work space for multiple meeting attendees. Often it is useful to enable meeting attendees seated at such a table to connect a computer or other device to the room's audio visual equipment so that the attendee can present content to other attendees in that room and the other video conferencing rooms. To facilitate such a connection, the video conferencing room may supply a cable for connecting the room's auto visual equipment to the audio and video outputs of an attendee's computer. With multiple attendees seated at a table, the cable may be shared or passed between two or more of those attendees during a meeting. Managing the cable to avoid unsightly tangles and to ensure ease of access can help create an aesthetic appearance for the room and for the table.

DRAWINGS

DETAILED DESCRIPTION

Introduction: Various embodiments described below assist in managing cables on desktops. Certain embodiments assist in managing a cable that can be shared between multiple users seated at a table. When not in use, a plug on one end of the cable can be held stationary in a readily accessible location on the table's surface. When needed, the plug can be retrieved. A raceway positioned along a rear side edge of the table provides a slot that allows the cable to be shifted from side to side along a length of the table and to be extended toward and retracted away from any user seated at the table. In this manner, a user seated at the side of the table away from the center can retrieve the plug from the center of the table's surface, pull the cord to one side of the table surface, and connect the plug to a desired port on the user's computer or other device. In doing so, the raceway manages the cable by providing a guide or slot for the cable to travel along the rear edge of the table. A stop affixed to the cable prevents the plug and at least a portion of the cable from be retracted through the raceway.

Figure 1:
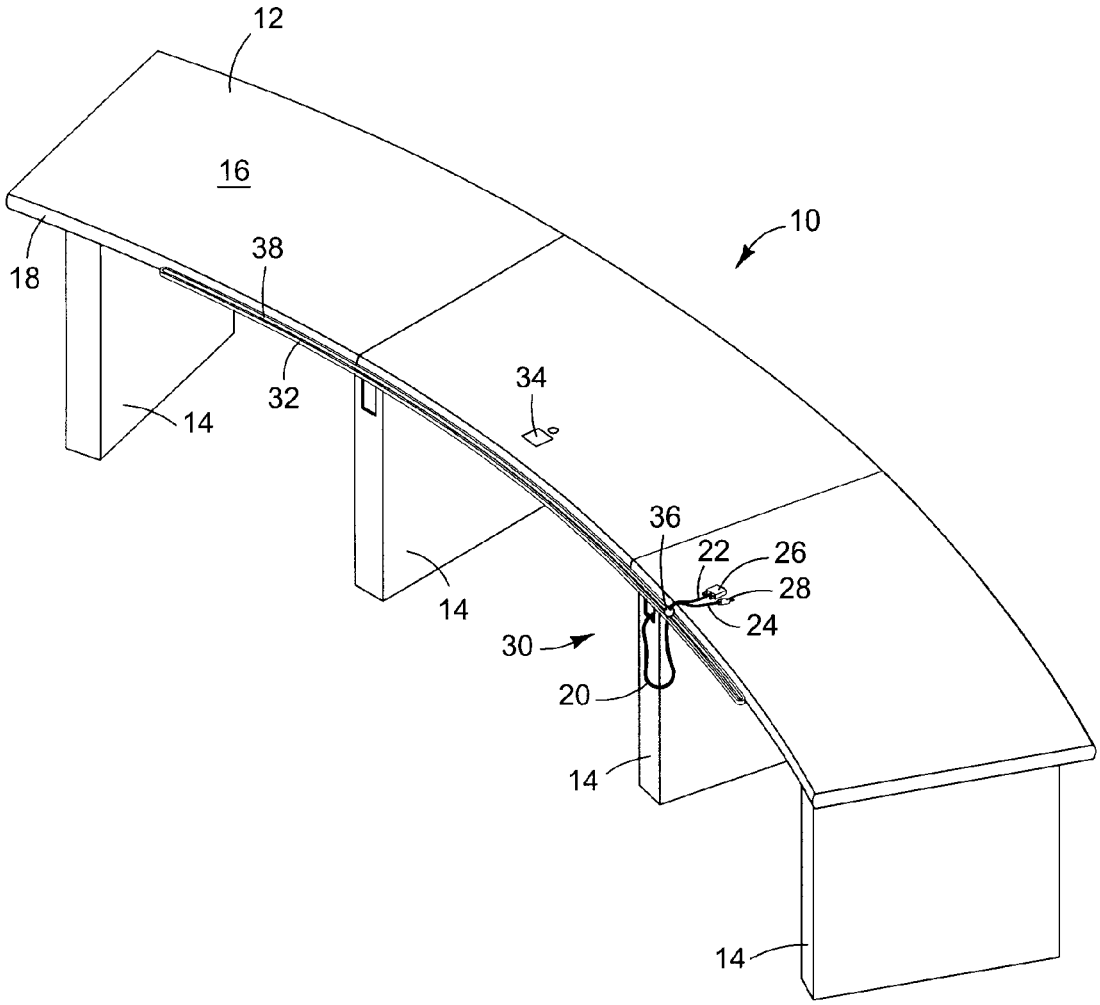
FIG. 1 is a perspective view of a table with a cable manager according to an exemplary embodiment.

Cable Manager: FIG. 1 is a rear perspective view of an exemplary table 10. Table 10 includes tabletop 12 supported by legs 14. Tabletop 14 includes a support surface 16 and an edge surface 18. Support surface 16 represents generally any surface capable of functioning as a work surface for users of table 10. Edge surface 18 bounds at least a portion of support surface 16 defining a thickness of tabletop 12. In this example, edge surface 18 bounds a rear edge support surface. The term rear is used to describe the edge of support surface 16 opposite to users seated at table 10.

Figure 2:
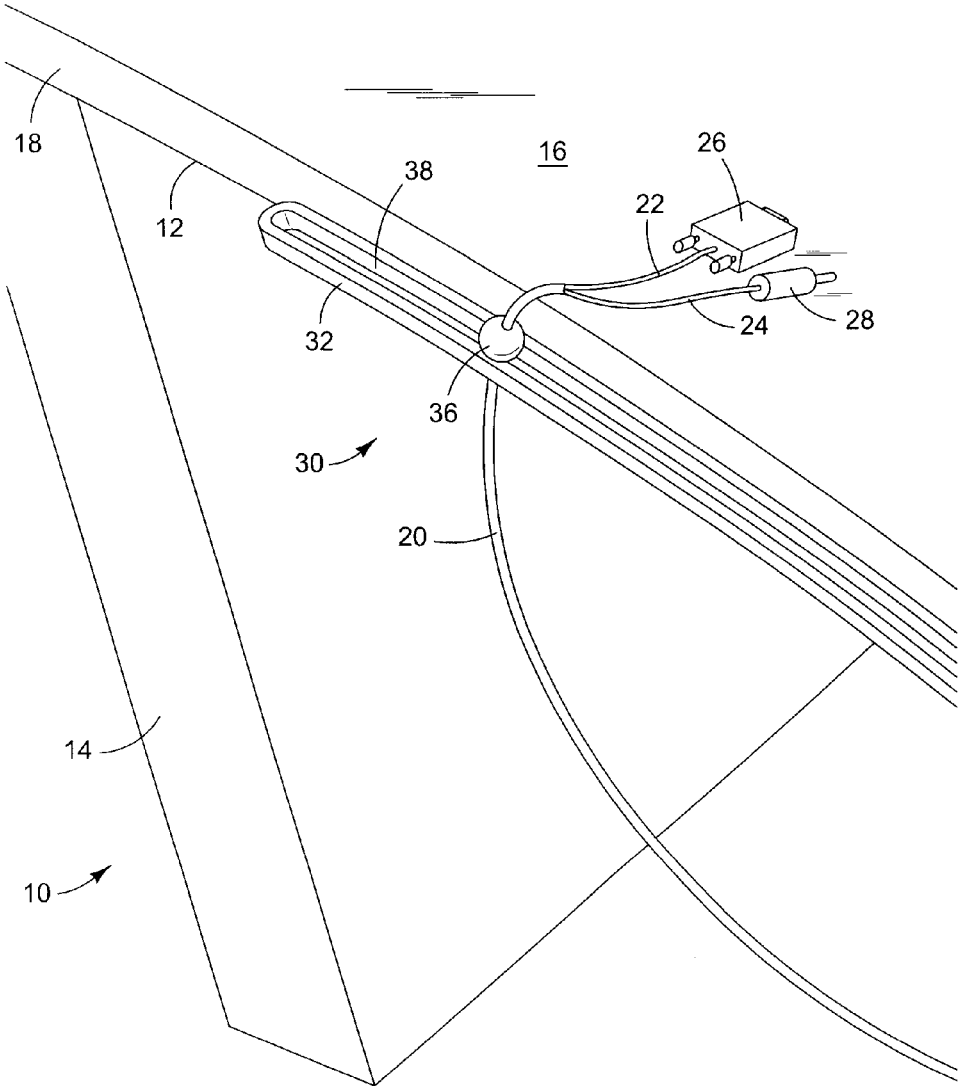
FIG. 2 is a close-up view of the cable manager of FIG. 1 showing a stop that prevents a cable from being fully retracted through a raceway according to an exemplary embodiment.

Referring to FIGS. 1 and 2, table 10 is equipped with a cable 20. Cable 20 allows a user of table 10 to utilize audio visual or other equipment for use in presenting information. In this example cable 20 includes video cord 22 and audio cord 24. Video cord 22 has an exposed end with video plug 26 while audio cable includes an exposed end with an audio plug 28. Here, plugs 26 and 28 are configured to connect to a user's computer or other device placed on support surface 16. While shown as including two cords serving audio and video functions, cable 20 can include any number of cords serving any of a variety of uses. Other examples include power cords and communication cords. Also, cable 20 may include a single cord that serves one or a plurality of functions. As an example, a single HDMI cord can serve both audio and video functions. As shown, cable 20 extends from support surface 16, down over rear edge surface 18 and disappears into one of legs 14. While not shown, cable 20 may then continue on and connect to one or more pieces of audio visual equipment.

Table 10 is shown to be equipped with cable manager 30. Cable manager 30 represents a combination of components configured to manage cable 20 to avoid unsightly tangles, to provide ease of access, and to improve an aesthetic appearance of table 10. In this example, cable manager 30 includes raceway 32, holder 34, and stop 36.

Raceway 30 represents generally any structure configured to be positioned lengthwise along at least a portion of a length of the edge surface 18. It is noted that raceway 30 may be attachable to or integrated into table top 12. Raceway 30 provides a slot 38 along and through which cable 20 can, with respect to the support surface 16, be moved laterally and extended and retracted. In other words cable 20 can be pulled upward through slot 38 to extend plugs 26 and 28. Gravity can pull cable 20 back down through slot 38 to retract plugs 26 and 28. Of course a force other than gravity can urge cable 20 back down through slot 38. Cable 20 can also be slid side to side within slot 38 along edge surface 18.

Figure 4:
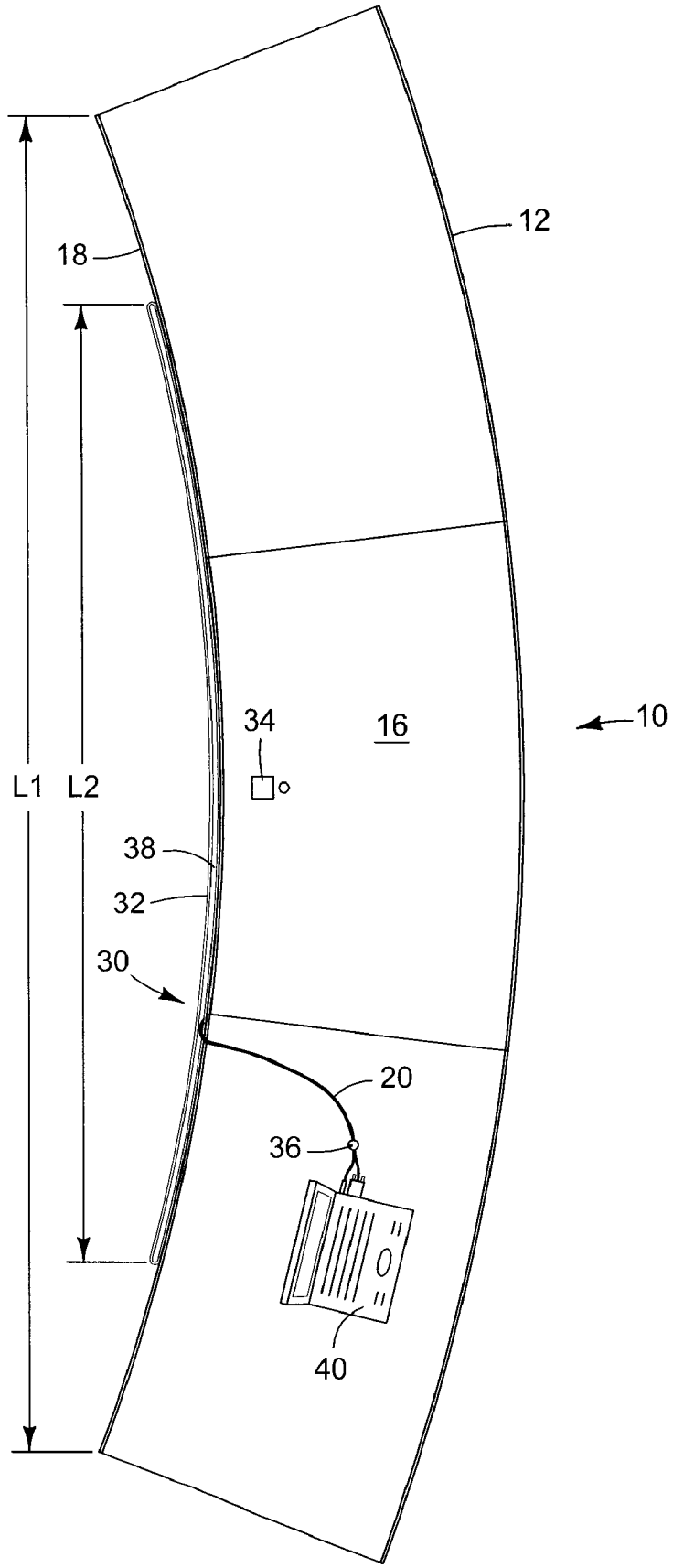
FIG. 4 is a top plan view of the table of FIG. 1 showing the plug having been moved from the stationary position shown in FIG. 3 to a new position where the plug is connected to a computer placed on the table.

With raceway 30 positioned along edge surface 18, slot 38 defines a path that conforms and runs adjacent to edge surface 18 but is separated from support surface 18. Referring for a moment to FIG. 4, tabletop 12 has a length (L1) that generally corresponds to a line or curve defined by an intersection of edge surface 18 and support surface 16. Slot 38 has a length (L2) that is about three quarters of the length of tabletop 12. In this fashion, when cable 20 is slid completely to one side or the other of slot 38, a user seated at either side of table 10 can easily access and utilize plugs 26 and 28. Moreover, when slid to either side of slot and connected to a device in from of a user seated at table 10, cable 20 extends directly away from that device passing down over rear edge surface 18 and through slot 38. In this fashion, cord 20 does not interfere with the space on support surface 16 in front of other users seated at table 10.

Referring back to FIGS. 1 and 2, holder 34 represents generally any structure configured to be positioned on support surface 16 to retain at least one of plugs 26 and 28 in a stationary position at a first location adjacent to support surface 16. In one example, holder 34 may include a magnetized surface recessed in support surface 16. The magnetic surface provides an attractive force on a metal portion of at least one of plugs 26 and 28 when that plug is placed in physical proximity to holder 34. The attractive force holds cable 20 in a stationary position where plugs 26 and 28 can be easily accessed by a user seated at table 10. A user can overcome the attractive force by pulling that plugs 26 and 28 away from the holder 34 to a desired location.

Stop 36 represents generally any structure configured to be affixed to cable 20 at a position along cable 20 between plugs 26 and 28 and slot 38. Stop 36 is sized so that it will not fit through slot 38. When cable 20 is retracted through slot 38, stop 36 when affixed to cable 20 prevents plugs 26 and 28 and at least a portion cable 20 from passing through slot 38. If a user drops cable 20, cable 20 retracts sliding through slot 38 until stop 36 contacts raceway 30. With a portion of cable 20 still extended out above slot 38, plugs 26 and 26 remain accessible to users seated at table 10.

Figure 3:
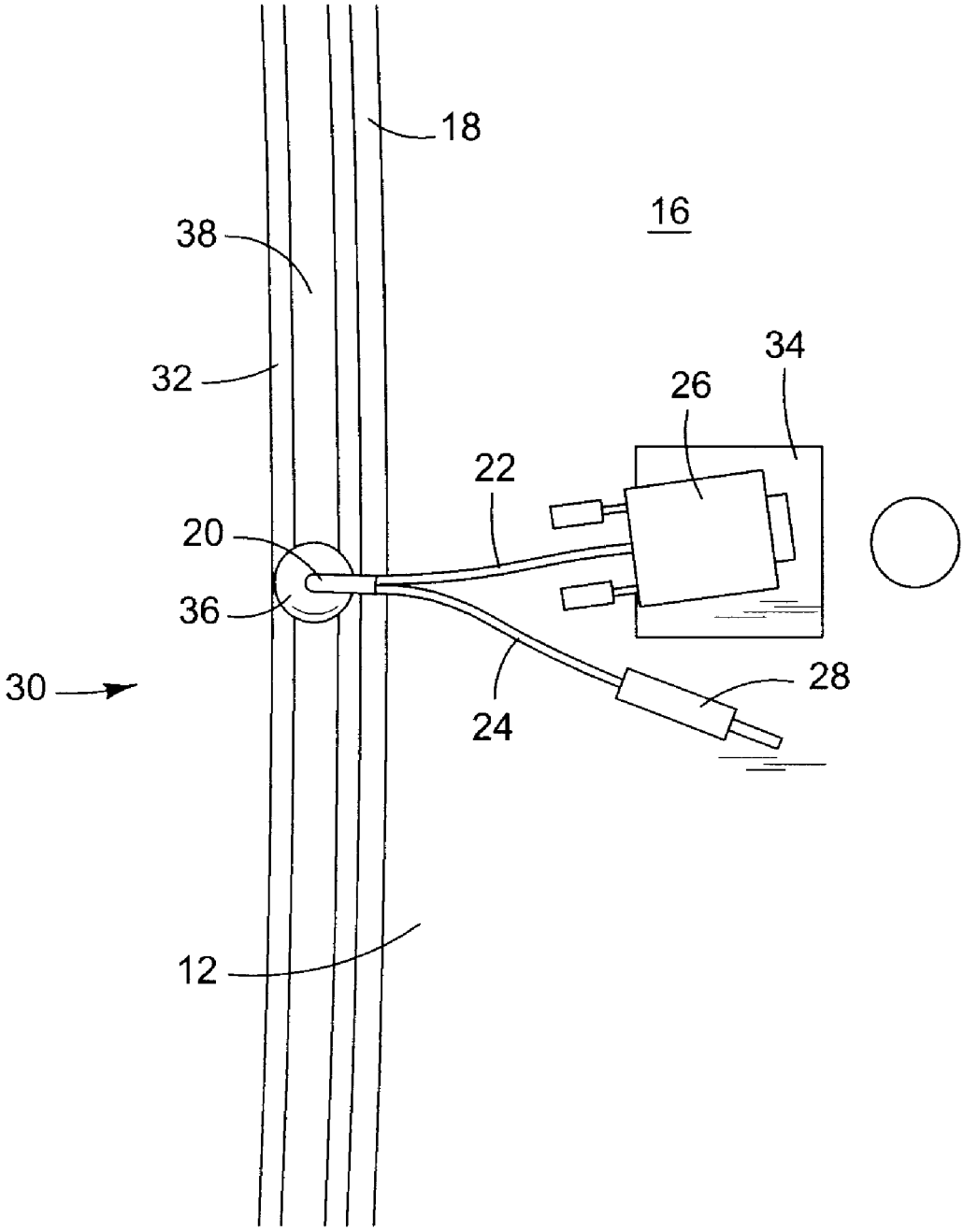
FIG. 3 is a partial top plan view of the table of FIG. 1 showing the plug found on an end of the cable being held in a stationary position according to an exemplary embodiment.

USE: Referring to FIG. 3, when not in use, plug 26 or 28 of cable 20 can be placed on holder 34. Where holder 34 includes a magnetic surface, the magnetic force attracts metal in plug 26 or 28 holding cable 20 in a stationary and accessible position on support surface 16.

FIG. 4, illustrates an example in which a user seated at one side of table 10 is using cable 20. Here, the user has removed plug 26 or 28 from holder 34 slid cable to a desired position along slot 38, extended an additional length of cable 20 through slot 38, and connected plugs 26 and 28 to a computer 40 placed on support surface 16. As can be seen, cable 20 extends from computer 40 taking a shortest path to slot 38. This positioning keeps cable 20 off of the portions of support surface 16 used by others seated at table 10. When finished, cable 20 can be returned to holder 34 as shown in FIG. 3.

CONCLUSION: The present invention has been shown and described with reference to the foregoing exemplary embodiments. It is to be understood, however, that other forms, details and embodiments may be made without departing from the spirit and scope of the invention that is defined in the following claims.

What is claimed is:

1. A cable manager for a tabletop having a support surface comprising a plurality of separate workspaces, each workspace capable of accommodating a human user, and an edge surface, the cable manager comprising:

a raceway for a cable having an end with a plug, the raceway configured to be positioned lengthwise along at least a portion of a length of the edge surface, the raceway extending to each of the workspaces for the plurality of human users provided on the support surface of the tabletop, the raceway providing a slot along and through which the cable can, with respect to the support surface, be moved laterally and extended and retracted such that the plug can be connected to a computing device located at any of the workspaces on the support surface of the tabletop; and a holder configured to be positioned on the support surface and to retain the plug in a stationary position at a first location adjacent to the support surface, the plug being removable from the holder to be repositioned to a desired one of a plurality of second locations adjacent to the support surface.

2. The cable manager of claim 1, further comprising a stop configured to be affixed to the cable at a position along the cable between the plug and the slot, wherein when the cable is retracted through the slot, the stop when affixed prevents the plug and at least a portion of the cable from passing through the slot.

3. The cable manager of claim 1, wherein the cable includes a plurality of cords and each of the cords has an end with a plug, wherein:

the raceway provides a slot along and through which the cords can, with respect to the support surface, be moved laterally and extended and retracted; and the holder is configured to retain at least one of the plugs in a stationary position at the first location adjacent to the support surface.

4. The cable manager of claim 1, wherein the holder comprises a magnetized surface configured to retain the plug in the stationary position at the first location by providing an attractive force on a metal portion of the plug when the plug is placed in physical proximity to the holder, the attractive force being overcome by pulling the plug away from the holder.

5. The cable manager of claim 1, wherein the tabletop has a length that generally corresponds to a line or curve defined by an intersection of the edge surface and the support surface and wherein the slot has a length that is about three quarters of the length of the tabletop.

6. The cable manager of claim 1, wherein the raceway is integrated into the tabletop.

7. The cable manager of claim 1, wherein the raceway is attachable to the tabletop.

8. An article of furniture, comprising:

a tabletop having a support surface comprising a plurality of separate workspaces, each workspace capable of accommodating a human user, and an edge surface bounding at least a portion of the support surface;

a plurality of legs configured to support the tabletop;

a cable having a first end with a plug;

a raceway positioned lengthwise along at least a portion of a length of the edge surface, the raceway extending to each of the workspaces for the plurality of human users provided on the support surface of the tabletop, the raceway providing a slot along and through which the cable can, with respect to the support surface, be moved laterally and extended and retracted such that the plug can be connected to a computing device located at any of the workspaces on the support surface of the tabletop; and a holder positioned on the support surface and to retain the plug in a stationary position at a first location adjacent to the support surface, the plug being removable from the holder to be repositioned to a desired one of a plurality of second locations adjacent to the support surface.

9. The article of furniture of claim 8, further comprising a stop affixed to the cable at a position along the cable between the plug and the slot, wherein when the cable is refracted through the slot, the stop prevents the plug and at least a portion of the cable from passing through the slot.

10. The article of furniture of claim 8, wherein the cable includes a plurality of cords and each of the cords has an end with a plug, wherein:

the raceway provides a slot along and through which the cords can, with respect to the support surface, be moved laterally and extended and retracted; and the holder is configured to retain at least one of the plugs in a stationary position at the first location adjacent to the support surface.

11. The article of furniture of claim 8, wherein the holder comprises a magnetized surface configured to retain the plug in the stationary position at the first location by providing an attractive force on a metal portion of the plug when the plug is placed in physical proximity to the holder, the attractive force being overcome by pulling the plug away from the holder.

12. The article of furniture of claim 8, wherein the tabletop has a length that generally corresponds to a line or curve defined by an intersection of the edge surface and the support surface and wherein the slot has a length that is about three quarters of the length of the tabletop.

13. The article of furniture of claim 8, wherein the cable is positioned such that the plug is positioned on a first side of the raceway, the cable passes from the plug through the slot and into a recess formed in one of the legs.

14. A cable manager for a tabletop having a support surface comprising a plurality of separate workspaces, each workspace capable of accommodating a human user, and an edge surface, the cable having an end with a plug, the cable manager comprising:

means for providing a slot along and through which the cable can, with respect to the support surface, be moved laterally and extended and retracted, the slot being positioned lengthwise along at least a portion of a length of the edge surface, the slot extending to each of the workspaces for the plurality of human users provided on the support surface of the tabletop such that the plug can be relocated and connected to a computing device located at any of the workspaces on the support surface of the tabletop; and means for retaining the plug in a stationary position at a first location adjacent to the support surface, the plug being removable from the means for retaining to be repositioned to a desired one of a plurality of second locations adjacent to the support surface.

15. The cable manager of claim 14, further comprising a means for preventing the plug and at least a portion of the cable from being retracted through the slot.

16. The cable manager of claim 14, wherein the cable includes a plurality of cords and each of the cords has an end with a plug, wherein:

the means for providing a slot comprises means for providing a slot along and through which the cords can, with respect to the support surface, be moved laterally and extended and retracted; and the means for retaining comprises means for retaining at least one of the plugs in a stationary position at the first location adjacent to the support surface.

17. The cable manager of claim 14, wherein the means for retaining comprises a means for magnetically retaining the plug in the stationary position at the first location by providing an attractive force on a metal portion of the plug when the plug is placed in physical proximity to the means for retaining, the attractive force being overcome by pulling the plug away from the means for retaining.

18. The cable manager of claim 14, wherein the tabletop has a length that generally corresponds to a line or curve defined by an intersection of the edge surface and the support surface and wherein the means for providing a slot comprises means for providing a slot that has a length that is about three quarters of the length of the tabletop.

19. The cable manager of claim 14, wherein the means for providing a slot is integrated into the tabletop.

20. The cable manager of claim 14, wherein the means for providing a slot is attachable to the tabletop.

* * * * *

UNITED STATES PATENT AND TRADEMARK OFFICE

CERTIFICATE OF CORRECTION

PATENT NO. : 8,272,335 B2
APPLICATION NO. : 12/236335
DATED : September 25, 2012
INVENTOR(S) : Mike Derocher et al.

It is certified that error appears in the above-identified patent and that said Letters Patent is hereby corrected as shown below:

In column 4, line 52, in Claim 9, delete “refracted” and insert -- retracted --, therefor.

Signed and Sealed this
Nineteenth Day of March, 2013

Teresa Stanek Rea
*Acting Director of the United States Patent and Trademark Office*